US008769846B1

(12) United States Patent
Williams

(10) Patent No.: US 8,769,846 B1
(45) Date of Patent: Jul. 8, 2014

(54) BOOT HAVING SKIN-EXFOLIATING MEANS THEREIN

(76) Inventor: Vernon Williams, Laurel, MD (US)

( * ) Notice: Subject to any disclaimer, the term of this patent is extended or adjusted under 35 U.S.C. 154(b) by 580 days.

(21) Appl. No.: 13/093,929

(22) Filed: Apr. 26, 2011

(51) Int. Cl.
*A43B 3/12* (2006.01)

(52) U.S. Cl.
USPC ..... 36/141; 36/8.1; 36/11.5

(58) Field of Classification Search
USPC ..... 36/8.1, 11.5, 141
See application file for complete search history.

(56) References Cited

U.S. PATENT DOCUMENTS

| | | | | | |
|---|---|---|---|---|---|
| 3,595,244 | A | * | 7/1971 | Kugler | 36/141 |
| 3,722,113 | A | * | 3/1973 | Birkenstock | 36/11.5 |
| 4,075,772 | A | * | 2/1978 | Sicurella | 36/43 |
| 4,345,387 | A | * | 8/1982 | Daswick | 36/43 |
| 4,694,831 | A | | 9/1987 | Seltzer | |
| 4,727,661 | A | * | 3/1988 | Kuhn | 36/100 |
| 5,371,958 | A | * | 12/1994 | Brosseau | 36/8.1 |
| 5,621,986 | A | | 4/1997 | Medina | |
| 5,930,916 | A | | 8/1999 | Connor | |
| 6,367,174 | B1 | * | 4/2002 | Shibata | 36/141 |
| D474,588 | S | | 5/2003 | Dean | |
| D506,053 | S | | 6/2005 | Cook | |
| 7,069,672 | B2 | | 7/2006 | Hahn | |
| 7,159,342 | B2 | | 1/2007 | Grisoni | |
| 7,264,599 | B1 | * | 9/2007 | Milligan | 601/28 |
| 7,614,167 | B2 | * | 11/2009 | Klavano | 36/141 |
| 8,109,012 | B2 | * | 2/2012 | Sarantakos et al. | 36/11.5 |
| 2004/0118015 | A1 | * | 6/2004 | Lai | 36/3 B |
| 2005/0115108 | A1 | * | 6/2005 | Palchetti | 36/44 |
| 2006/0156583 | A1 | | 7/2006 | Butash | |
| 2007/0094893 | A1 | | 5/2007 | Flores | |
| 2008/0022561 | A1 | * | 1/2008 | Klavano | 36/141 |

* cited by examiner

*Primary Examiner* — Marie Bays

(57) ABSTRACT

The boot having skin-exfoliating means therein is a normal boot that when worn targets different regions of a foot and exfoliates dead skin from said regions of the foot, but in different exfoliating manners. The exfoliating means are designed to massage and exfoliate dead skin from the foot of an end user. The exfoliating means comprise massaging nodes aligned along a front, interior of the boot, which target skin between toes. Another exfoliating means is included along a middle region of the sole and includes an array of nodes that exfoliate skin along a bottom surface of the foot. Exfoliating ridges are located on two regions of the sole and are adapted to exfoliate skin at the rear of the foot and between the array of nodes and massaging nodes. Edge ridges adorn a periphery of the sole and provide additional exfoliating means.

5 Claims, 3 Drawing Sheets

BOOT HAVING SKIN-EXFOLIATING MEANS THEREIN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of boots and items worn on a foot, more specifically, a boot that has skin exfoliating means integrated inside of the boot.

B. Discussion of the Prior Art

As will be discussed immediately below, no prior art discloses a boot in which a plurality of exfoliating means are integrated into an interior of said boot such that upon wearing said boot, skin of an end user's feet shall be exfoliated and cleared of dead skin; wherein the exfoliating means comprise different regions within the boot, and more generally along the sole of the boot; wherein the exfoliating means comprises massaging nodes aligned along a front interior of the boot, which are ideally suited for exfoliating skin from between toes of an end user; wherein exfoliating means include an array of means includes two regions of the sole and comprise directional ridges; and wherein exfoliating means include edge ridges that adorn the periphery of the sole of the boot.

The Flores Patent Application Publication (U.S. Pub. No. 2007/0094893) discloses a disposable flip-flop with exfoliating and moisturizing functions. However, the exfoliating function is not composed of distinct regions of differently-styled exfoliating means that work to exfoliate different aspects of an end user's foot.

The Butash Patent Application Publication (U.S. Pub. No. 2006/0156583) discloses a pedicure show insert, which includes a top layer of textured file paper that furnishes the wearer with an exfoliating pedicure and a lower layer of a cushion material that provides support and comfort to the wearer. However, the shoe insert does not include exfoliating means that comprise different regions of the sole and of which perform different exfoliating functions specific to the respective region of an end user's foot.

The Grisoni et al. Patent (U.S. Pat. No. 7,159,342) discloses a removable ball of the foot insert for placement into footwear that includes a substantially planar member made from a viscoelastic gel. However, the insert only targets the ball of the foot and is not a part of a boot having different exfoliating regions, which employ different styles of exfoliating means.

The Hahn Patent (U.S. Pat. No. 7,069,672) discloses a shoe with a foot-massaging effect. However, the shoe does not exfoliate skin from different areas of a foot.

The Connor Patent (U.S. Pat. No. 5,930,916) discloses a footwear insole and footwear incorporating loofah material. However, the footwear does not use exfoliating ridges and nodes to exfoliate skin in different manners at different regions of the foot.

The Medina et al. Patent (U.S. Pat. No. 5,621,986) discloses a slip-on shoe shaped so that it can be worn on either foot of a user, and includes a pumice stone that is attached to a top surface of the shoe. However, the pumice stone is located on an exterior of the shoe and is not inside of the shoe.

The Seltzer Patent (U.S. Pat. No. 4,694,831) discloses a massaging footwear with an inner sole having upwardly protecting raised flat foot support platforms with foot stimulating, dome-shaped, spaced massage bumps, and non-specific rounded projections on the areas of the inner sole not occupied by the platforms. However, the footwear is directed to massaging a foot and not also for exfoliating dead skin from said foot by integrated exfoliating means of unique styles in different regions in order to exfoliate dead skin in manners specific to different areas of the foot.

The Daswick Patent (U.S. Pat. No. 4,345,387) discloses a resilient inner sole for a shoe integrally formed from resilient material into a generally flat sheet member. However, the inner sole does not teach massaging nodes aligned along the front portion of the sole, which specifically target skin between toes.

The Dean Patent (U.S. Pat. No. Des. 474,588) illustrates an ornamental design for an insole cushion, which does not teach an insole that includes different styles of exfoliating means at different regions of the sole.

The Cook Patent (U.S. Pat. No. Des. 506,053) illustrates an ornamental design for a pair of soles, which does not teach an insole that includes different styles of exfoliating means at different regions of the sole.

While the above-described devices fulfill their respective and particular objects and requirements, they do not describe a boot in which a plurality of exfoliating means are integrated into an interior of said boot such that upon wearing said boot, skin of an end user's feet shall be exfoliated and cleared of dead skin; wherein the exfoliating means comprise different regions within the boot, and more generally along the sole of the boot; wherein the exfoliating means comprises massaging nodes aligned along a front interior of the boot, which are ideally suited for exfoliating skin from between toes of an end user; wherein exfoliating means include an array of nodes adoring a middle region of the sole; wherein exfoliating means includes two regions of the sole and comprise directional ridges; and wherein exfoliating means include edge ridges that adorn the periphery of the sole of the boot. In this regard, the boot having skin-exfoliating means therein departs from the conventional concepts and designs of the prior art.

SUMMARY OF THE INVENTION

The boot having skin-exfoliating means therein is a normal boot that when worn targets different regions of a foot and exfoliates dead skin from said regions of the foot, but in different exfoliating manners. The exfoliating means are designed to massage and exfoliate dead skin from the foot of an end user. The exfoliating means comprise massaging nodes aligned along a front, interior of the boot, which target skin between toes. Another exfoliating means is included along a middle region of the sole and includes an array of nodes that exfoliate skin along a bottom surface of the foot. Exfoliating ridges are located on two regions of the sole and are adapted to exfoliate skin at the rear of the foot and between the array of nodes and massaging nodes. Edge ridges adorn a periphery of the sole and provide additional exfoliating means.

An object of the invention is to provide a boot with massaging and exfoliating means integrated into the interior of said boot such that upon wearing said boot an end user's foot is massaged and exfoliated of dead skin.

A further object of the invention is to provide alternative exfoliating means that are located in regions within said boot, which specifically target specific areas of the foot and massage and exfoliate said area of the foot, which take skin sensitivity into consideration.

A further object of the invention is to provide a series of massaging nodes along a front, interior of the sole of the boot, which target skin between the toes.

These together with additional objects, features and advantages of the boot having skin-exfoliating means will be readily apparent to those of ordinary skill in the art upon reading the following detailed description of presently preferred, but nonetheless illustrative, embodiments of the boot having skin-exfoliating means therein when taken in conjunction with the accompanying drawings.

In this respect, before explaining the current embodiments of the boot having skin-exfoliating means therein in detail, it is to be understood that the boot having skin-exfoliating means therein is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the boot having skin-exfoliating means therein.

It is therefore important that the claims be regarded as including such equivalent construction insofar as they do not depart from the spirit and scope of the boot having skin-exfoliating means therein. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
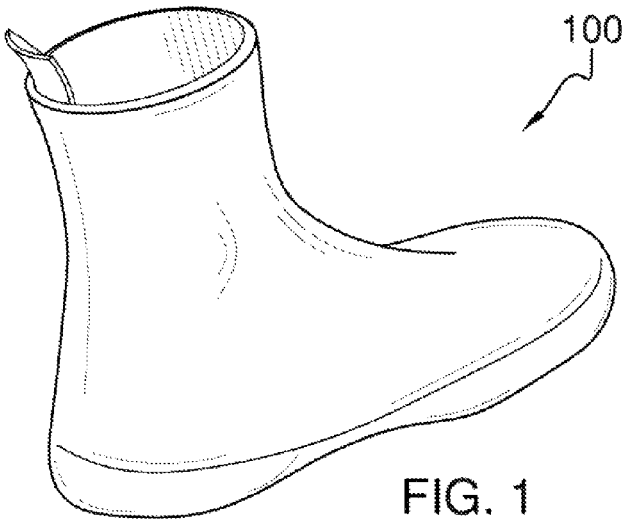
FIG. 1 illustrates a rear, perspective view of the boot by itself.
Figure 2:
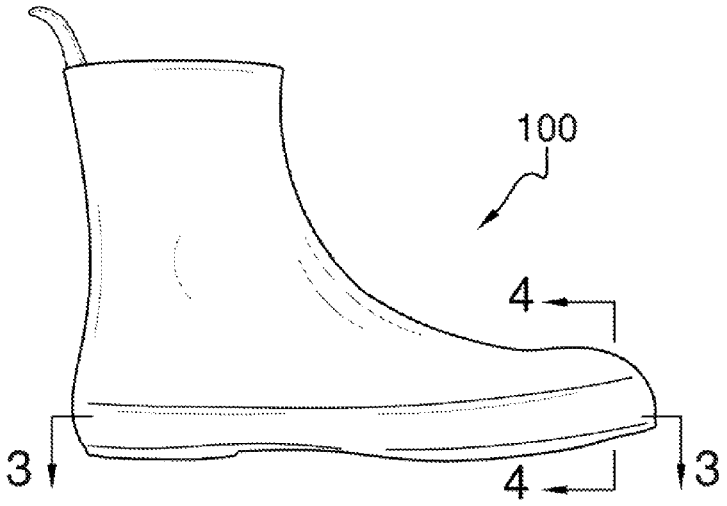
FIG. 2 illustrates a side view of the boot by itself, and resembling a standard boot.
Figure 3:
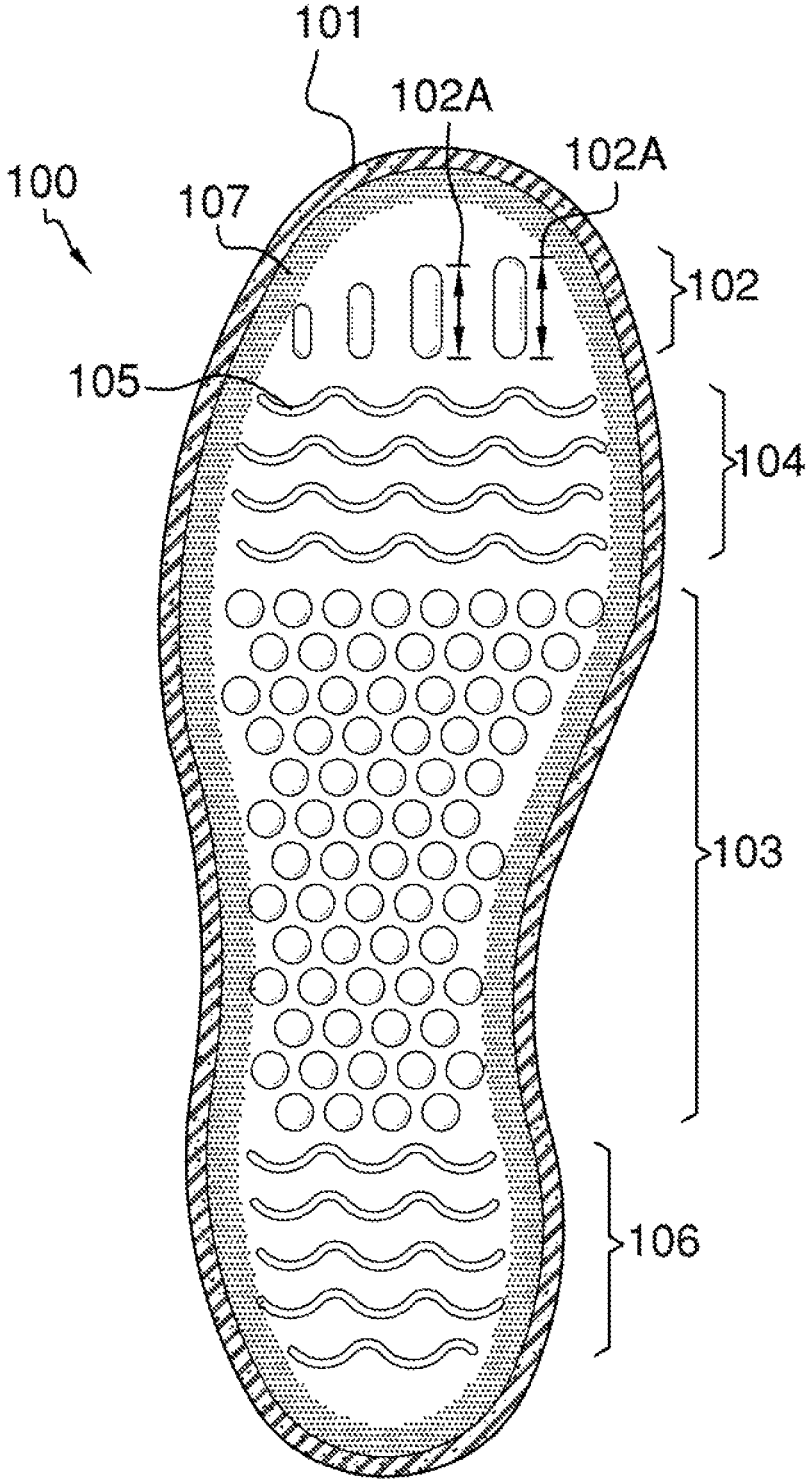
FIG. 3 illustrates a cross-sectional view of the boot along line 3-3 in FIG. 2, and depicting the plurality of ridges and nodes adorning specific regions of the sole of the boot.
Figure 4:
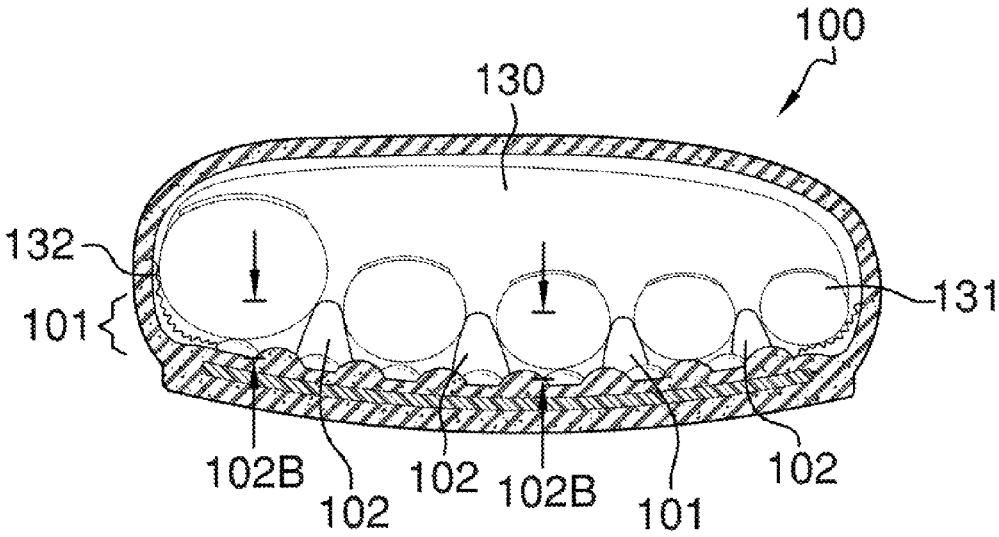
FIG. 4 illustrates a cross-sectional view of the boot along line 4-4 in FIG. 2, and depicting the massaging nodes impacting skin between toes of an end user as well as edge ridges impacting bottom, corner periphery of said foot.

Detailed reference will now be made to the preferred embodiment of the present invention, examples of which are illustrated in FIGS. 1-4. A boot having skin-exfoliating means therein 100 (hereinafter invention) includes a sole 101 located within said boot. The sole 101 is divided up into different exfoliating regions, which include a plurality of massaging nodes 102.

The massaging nodes 102 are elongated members that are aligned along a front portion of the sole 101. The massaging nodes 102 are designed to impact skin located between toes 131 of a foot 130. The massaging nodes 102 are each uniquely shaped in that lengths 102A and heights 102B vary from one massaging node 102 to another massaging node 102.

An array of nodes 103 adorn a second region of the sole 101, and are comprised of semi-spherical protuberances designed to massage and exfoliate skin along a bottom surface of the foot 130.

A third region 104 is comprised of exfoliating ridges 105 that traverse laterally across the sole 101. The exfoliating ridges 105 work to massage and exfoliate skin situated between the toes down to the Metatarsus. A fourth region 106 is included on the sole 101, and utilizes a plurality of exfoliating ridges 105 that traverse laterally across the sole 101. The fourth region 106 is designed to massage and exfoliate skin from the rear of the foot 130.

A periphery of the sole 101 is adorned with edge ridges 107, which are designed to massage and exfoliate skin along a bottom periphery 132 of the foot 130.

The massaging nodes 102, the array of nodes 103, the third region 104, the fourth region 106, and the edge ridges 107 form all of the relative zones of the sole 101, and include exfoliating means that are unique to different manners of exfoliating dead skin and/or massaging the respective portion of the foot 130. The location and types of exfoliating means are arranged so as to take into consideration differing skin sensitivities at different locations of the foot 130. That being said, it shall be noted that skin along the bottom periphery 132 is less sensitive than skin located adjacent the array of nodes 103. Additionally, it shall be noted that the skin adjacent the third region 104 and the fourth region 106 is usually less sensitive than skin located adjacent the array of nodes 103.

The sole 101, the massaging nodes 102, the array of nodes 103, the third region 104, the fourth region 106, and the edge ridges 107 are all made of a material comprising a rubber or plastic.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A boot having skin-exfoliating means therein comprising:

a sole upon which exfoliating means adorn different regions to exfoliate skin and massage a foot therein;

wherein a plurality of massaging nodes are aligned along a front portion of the sole; wherein the massaging nodes massage and exfoliate skin located between toes of the foot;

wherein the massaging nodes are each uniquely shaped and vary in length and height;

wherein an array of nodes adorn a second region of the sole; wherein the nodes are comprised of semi-spherical protuberances;

wherein a third region located on the sole is comprised of exfoliating ridges that traverse laterally across the sole.

2. The boot having skin-exfoliating means therein as described in claim 1 wherein a fourth region is included on the sole, and utilizes a plurality of exfoliating ridges that traverse laterally across the sole.

3. The boot having skin-exfoliating means therein as described in claim 1 wherein a periphery of the sole is adorned with edge ridges, which are designed to massage and exfoliate skin along a bottom periphery of the foot.

4. A boot having skin-exfoliating means therein comprising:

a sole upon which exfoliating means adorn different regions to exfoliate skin and massage a foot therein;

wherein a plurality of massaging nodes are aligned along a front portion of the sole;

wherein the massaging nodes massage and exfoliate skin located between toes of the foot;

wherein an array of nodes adorn a second region of the sole; wherein the nodes are comprised of semi-spherical protuberances;

wherein the massaging nodes are each uniquely shaped and vary in length and height;

wherein a third region located on the sole is comprised of exfoliating ridges that traverse laterally across the sole;

wherein a fourth region is included on the sole, and utilizes a plurality of exfoliating ridges that traverse laterally across the sole.

5. The boot having skin-exfoliating means therein as described in claim 4 wherein a periphery of the sole is adorned with edge ridges, which are designed to massage and exfoliate skin along a bottom periphery of the foot.

* * * * *